United States Patent [19]

Thygesen

[11] Patent Number: 4,689,249

[45] Date of Patent: Aug. 25, 1987

[54] METHOD AND APPARATUS FOR APPLYING A COAT OF ADHESIVELY BONDED EXPANDED MINERAL GRAINS TO A SURFACE OF A STRUCTURE

[75] Inventor: Soren Thygesen, Snekkersten, Denmark

[73] Assignee: Micaform A/S, Snekkersten, Denmark

[21] Appl. No.: 819,505

[22] PCT Filed: May 2, 1985

[86] PCT No.: PCT/DK85/00044

§ 371 Date: Dec. 24, 1985

§ 102(e) Date: Dec. 24, 1985

[87] PCT Pub. No.: WO85/05142

PCT Pub. Date: Nov. 21, 1985

[30] Foreign Application Priority Data

May 4, 1984 [DK] Denmark ..... 2249/84

[51] Int. Cl.[4] ..... B05D 1/12

[52] U.S. Cl. ..... 427/180; 427/221; 427/196; 427/426; 427/397.8; 118/303

[58] Field of Search ..... 427/196, 221, 426, 397.8, 427/421, 180; 118/303

[56] References Cited

U.S. PATENT DOCUMENTS 1,978,125 10/1934 Bennett ..... 427/196
4,179,535 12/1979 Kalbskopf et al. ..... 427/397.8 X
4,491,608 1/1985 Thygesen ..... 427/426 X
4,520,073 5/1985 Randolph et al. ..... 427/221 X
4,525,388 6/1985 Rehder ..... 427/221 X

FOREIGN PATENT DOCUMENTS 146014 5/1983 Denmark .
0106246 4/1984 European Pat. Off. .

*Primary Examiner*—Shrive P. Beck
*Attorney, Agent, or Firm*—Watson, Cole, Grindle & Watson

[57] ABSTRACT

A granular expanded mineral material, e.g. vermiculite, is caused to move in the form of a free flow (28) through a mist (46) produced by an atomizer (29). A waterglass solution and a hardener therefor are supplied through conduits (32,43) and (33,42) respectively, to the intrior of the atomizer (29) for co-atomization to produce said mist (46). A small amount of hydrophobizing agent non-emulsifiable in the waterglass solution is introduced into the stream of waterglass solution in the conduit (32,43). An in-line mixer (53) is built into that conduit immediately ahead of its exit (45) to the atomizer. By passing through the atomized mist (46) the grains of the expanded mineral material are individually coated with a film of waterglass solution and hardener with hydrophobizing agent finely distributed therein. The film-coated granular material is immediately thereafter pneumatically conveyed to a place of deposition on a surface, e.g. a roof surface, and is spread thereon and lightly compressed to form a firmly coherent, water repellent coat on that surface.

7 Claims, 2 Drawing Figures

Figure 1:
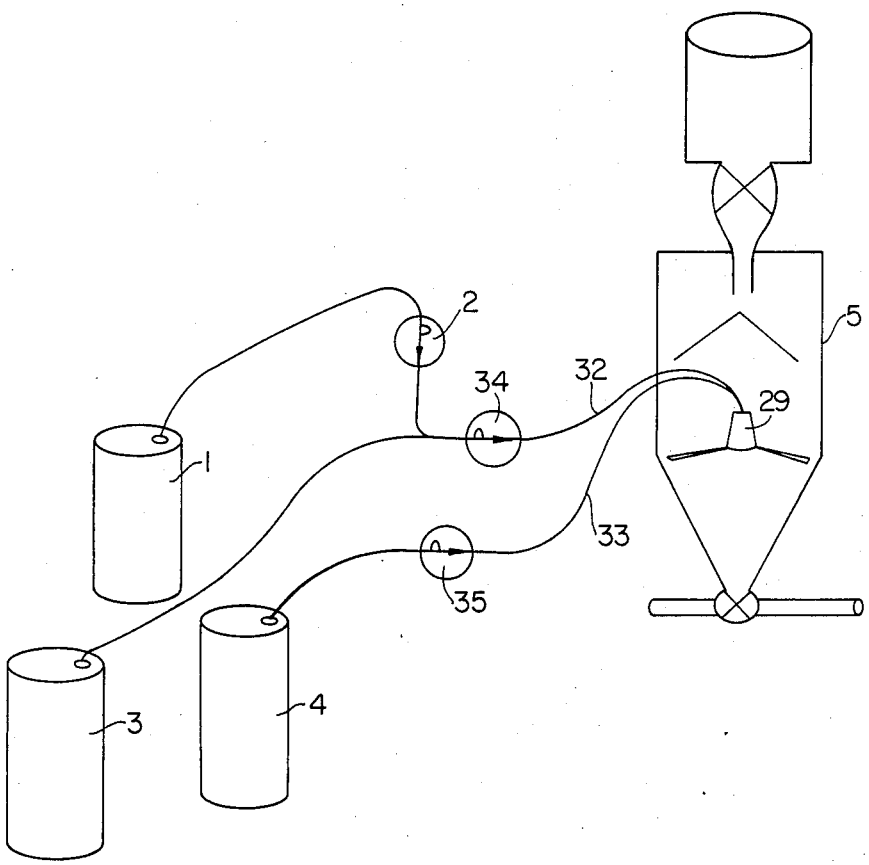

METHOD AND APPARATUS FOR APPLYING A COAT OF ADHESIVELY BONDED EXPANDED MINERAL GRAINS TO A SURFACE OF A STRUCTURE

The invention relates to a method of applying a coat of adhesively bonded expanded mineral grains to a surface of a structure, comprising the steps of causing a granular expanded mineral material to move in the form of a free flow through an atomized spray of an adhesive consisting of a solution of waterglass and a hardener therefor in such a manner as to form a film coating of said adhesive on the surface of each grain, and conveying the spray coated granular material, immediately after it has been thus produced, to the surface to be coated, depositing it on that surface and then spreading, compressing and smoothing it to form a coherent layer of a desired geometrical surface configuration.

Such a method is known from the Danish patent specification No. 146,014, and a further development is disclosed in Danish patent application No. 515/82 (cf. also U.S. Pat. No. 4,491,608 issued Jan. 1st, 1985). In both cases the method is more particularly directed to the laying of a screed-coat on a roof surface, and this is also an important field of use of the present invention, to which special attention will be paid in the following, though the invention is not limited to this particular use, but may also be used for applying a coat to other surfaces of structures, such as walls and partitions of building, building constructions, ships etc..

It is a characteristic of the known method that the grains of the granular expanded material are subjected to a minimum of mechanical forces until the moment they are deposited on the surface to be coated, so that they will maintain their expanded structure practically unaffected. Moreover, by evaporation of water after the spray coating of the grains, the waterglass binder changes characteristics and behaves more like a contact adhesive. At the point of deposition on the surface of the structure the spray coated grains therefore still behave almost like a granular material. It can be spread and shoveled like loose snow, and when in place one can by a light pressure activate the "contact adhesive" and stabilize the material. The material as deposited is therefore excellently workable to build up a layer of a desired geometrical surface configuration and has a sufficient viscosity for being laid with a sloping surface.

The known method is ideally suited for the renovation of defective built-up roofs with lack of gradient towards gutters and drains and frequently with surface cavities in which water may collect. On such a roof, the spray coated granular material is applied as a layer with correct gradient from all points towards drains, whereafter a new waterproof roof covering can be applied on top of the screed coat. The screed coat material has a density so low that it can be carried even by a light roof supporting structure which was originally dimensioned only to carry a certain snow load. The curing time can be made very short, and after curing the coat has a sufficient strength to permit the workers to step on it during the subsequent steps of the full re-roofing process. The screed-coat material has good heat insulation properties and is fire-proof and resistant to water in the sense that it is in no way deteriorated by water which may accidentally get access to it.

However, the screed-coat material as applied by the known method suffers from the drawback that it is highly absorptive to water by capillary effect. Therefore, if water accidentally gets access to it, e.g. owing to defective performance of the superposed waterproof roof-covering or subsequent damaging of the latter, it may in the course of time suck in so much water that it not only looses its insulating power, but even becomes so heavy that it may deform the roof supporting structure in a harmful manner.

The tendency to absorption of water could be reduced if the granular raw material were used in the form of a hydrophobized product. Hydrophobization is a process by which an expanded mineral granulate, while still hot from the expansion process, is sprayed with a hydrophobizing agent to make the granulate hydrophobic i.e. water repellent. The use of hydrophobized raw materials in carrying out the known method referred to has however been found to give problems with the adhesion between the individual grains and unsatisfactory cohesive strength is found in the cured material.

It is the object of the invention to eliminate the said drawbacks of the known method.

To achieve this, according to the invention, a small amount of a hydrophobizing agent, which is non-emulsifiable in the adhesive, is introduced into the adhesive and is uniformly distributed therein by mechanical forces immediately before the atomizing operation.

By the term "non-emulsifiable" as applied to the hydrophobizing agent is to be understood that this cannot form a stable emulsion in the waterglass solution, but will separate out very quickly, if a mixture of the two, produced by mechanical forces, is left to itself.

It has been found that by proceeding in accordance with the invention it is possible practically to eliminate the capillary absorption of water in the coat without perceptibly reducing the adhesion between the individual grains of the coat and thereby the cohesive strength of the cured material. In fact, all advantages inherent in the known method are maintained, and the operating steps to be performed by the personnel are unchanged, but the final product, viz. the coat applied to the surface, has obtained a further valuable property, viz. that of water repellency.

The use of hydrophobizing agents in the preparation of granular expanded mineral materials is not in itself new. Thus, European Patent Application No. 0 106 246 discloses a rigid, heat stable, strong, impact resistent, water repellent thermal insulation material. The material is made from expanded perlite, alkali metal silicate solution, kaolin clay, and organic fiber. Additions of methylcellulose and polydimethyl silicone liquid as a hydrophobizing agent enhance the strength and water repellency characteristics of the insulation material. The material is made by mixing the ingredients in a Hobart mixer or V-shell blender. After mixing, the mixture is pressed into a mold to form a molded article, and the molded article is cured and dried in a hot air dryer at a temperature of about 77° C. for about 24 hours or longer to produce an insulation material. Particularly useful shapes for the molded articles are pipe and block shapes.

Although the expanded perlite/alkali metal silicate insulation material disclosed in the European Patent Application No. 0 106 246 has many desirable properties, the method by which it is prepared and the mechanical nature of the expanded perlite will not allow its use in applications where an inorganic thermal resistant insulation must be formed in situ, and under ambient temperature conditions.

In the method according to the invention, the binder solution is applied to the grains by a spray-atomizing operation. The binder solution must therefore be of a low viscosity, and it would not be possible to stabilize the suspension of hydrophobizing agent by adding ingredients increasing the viscosity, such as is the case in the method of the European Patent Application. Instead, purely mechanical forces are used for making the suspension, but experience has shown that the very unstable suspension thus made behaves in such a way that it will not prevent the establishment of firm adhesive contact between the grains when these are rapidly thereafter deposited on the surface and lightly compressed, and that the hydrophobizing agent will permanently remain distributed in the pores and cavities of the material in such a manner as efficiently to oppose capillary travel of water.

Preferably, the hydrophobizing agent is a silicone product emulsified in a liquid. An example of a suitable silicone product is that marketed under the trademark DOW CORNING 347 EMULSION, which is described as a stable, water dilutable non-ionic polydimethyl siloxane. Experiments have shown that an efficient capillary repulsion is obtained by mixing 1–3% by weight, preferably 1.5–2.5% by weight, of this silicone product into the waterglass, immediately before this, together with a hardener, is atomized and sprayed onto the surfaces of the expanded mineral grains.

A granular expanded mineral material particularly suitable for use as raw material in carrying out the method according to the invention is vermiculite. It is a characteristic of this material that it is compressible under light pressure, whereby the cohesion of the grains in the material as deposited and spread on the surface to be coated is enhanced. Other expanded mineral raw materials (whether occurring in nature or manufactured) having the same property, could also be used with advantage.

In connection with the invention, the step of conveying the spray-coated granular material directly from the place of film coating to the place of deposition on the surface to be coated, has the special advantage that the strong evaporation from the film on each grain caused by the flow of air, usually at a somewhat elevated temperature, has a beneficial effect on the distribution of the droplets of hydrophobizing agent.

As mentioned this distribution was originally established by introducing the hydrophobizing agent into a stream of the adhesive and then subjecting the stream to mechanical forces. The device used for this purpose is an in-line mixer, of which various types are available. Preference is given to so-called static mixers, i.e. mixers without moving parts, and in which stationary guiding elements fitted in the pipeline achieve the mixing effect by continuous splitting, rearrangement and reunification of the product stream. Mixers suitable for the purpose of the invention are marketed by SULZER under the type denominations SMV, SMX and SMXL.

The invention also relates to an apparatus for use in carrying out the method. The known and novel features of this apparatus are indicated in claim 7.

Figure 2:
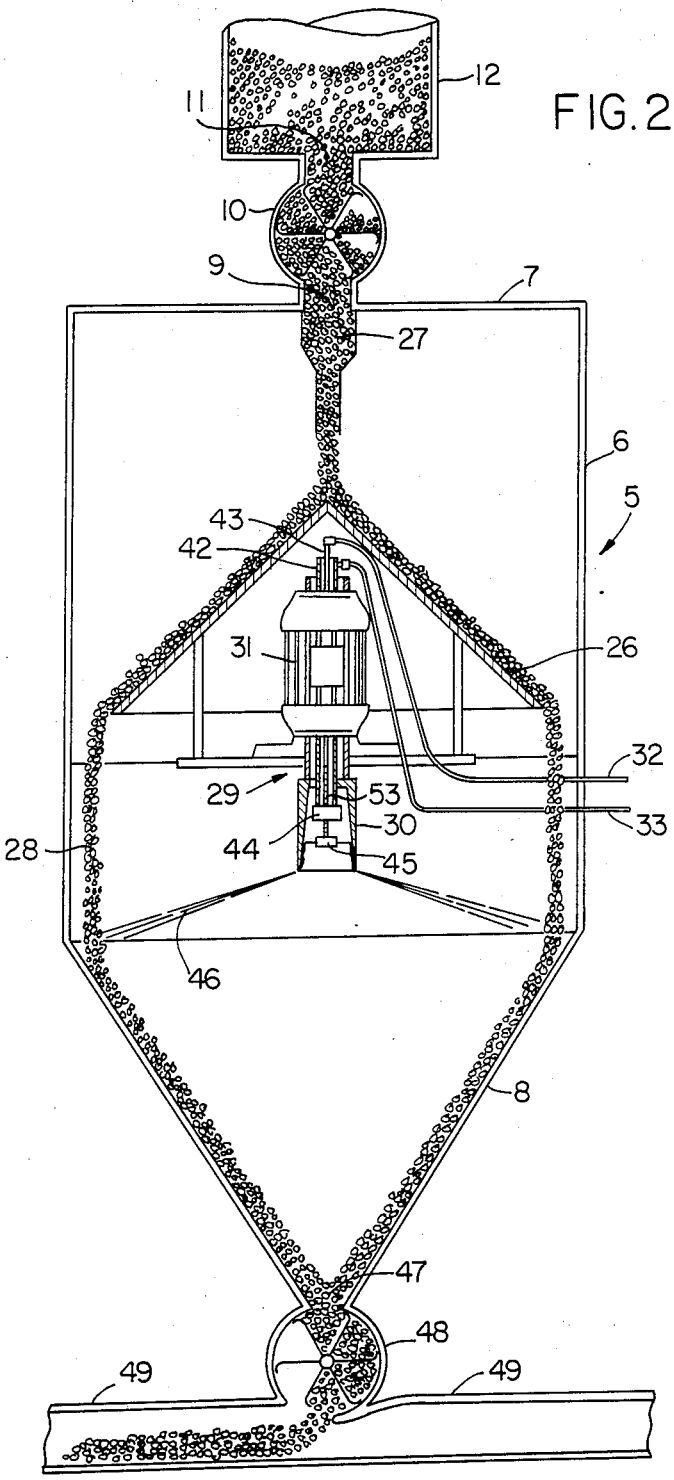

One mode of carrying out the invention will now be described with reference to the accompanying drawings, in which FIG. 1 is a diagram illustrating the supply of raw materials to an atomizing chamber, and FIG. 2 shows a vertical section through the atomizing chamber.

In the mode to be described, the method is used for the application of a screed coat to a roof surface, as in Danish Patent No. 146 014 and Danish patent application No. 515/82.

Raw materials suitable for carrying out the method according to the invention are:

(1) An expanded mineral granulate having a grain size of 0.5–6 mm and a bulk specific gravity of 50–100 kg/m$^3$, e.g. vermiculite.

(2) A saturated aqueous solution of sodium silicate (sodium waterglass) having an $SiO_2/Na_2O$ ratio $\geqq 3.3$, a denisty of approximately 1400 kg/m$^3$ and a dry substance content of 30–40%.

(3) As a hardener or curing agent, the organic ester triacetin, which is a liquid having a density of 1170 kg/m$^3$.

(4) As a hydrophobizing agent, the silicone emulsion "Silicone Release Agent", DOW CORNING 347 EMULSION, which is a stable aqueous emulsion having a density of approximately 1000 kg/m$^3$.

The proportion by weight of granulate/waterglass-/hardener/hydrophobizing agent may be approximately 100/50/2.5/1.

In FIG. 1 it is seen that waterglass from a drum 3 and hardener from a drum 4 are supplied through conduits 32 and 33, respectively, with built-in monopumps 34 and 35, respectively, to an atomizer 29 in an atomizing chamber 5, to be described below with reference to FIG. 2. From a drum 1 an adjusted amount of silicone emulsion is introduced via a conduit with built-in hose pump 2 into the waterglass conduit on the suction side of the monopump 34. Thus, the silicone emulsion is supplied to the atomizer 29 together with the waterglass without being subjected to any significant mixing action.

In FIG. 2 it is seen that the atomizing chamber has an upper cylindrical portion 6 closed at its top by a top wall 7, and a lower conical portion 8. A central opening 9 in the top wall 7 is connected through a cell feeder 10 with a bottom opening 11 of a buffer silo 12 to which the granular mineral material can be fed, in a manner not illustrated, by a pneumatic conveying system for delivery through a cyclone and a rotary valve.

In the cylindrical portion 6 of the atomizing chamber there is mounted a stationary spreader 26 shaped as an inverted cone. The tip of the spreader is located directly below a spout 27 connected to the central opening 9 of the top wall 7. The granular material dropping from the spout 27 onto the spreader 26 slides and/or rolls down its conical surface and leaves its lower edge in the form of a cylindrical curtain 28 of freely falling grains.

The rotational atomizer 29 mounted under the spreader is of a type well known per se. The atomizer consists mainly of an inverted cup 30, which is rotated at high speed, e.g. 5,000–6,000 r.p.m. by means of an electrical motor 31 having a hollow shaft. Waterglass with silicone emulsion added thereto and hardener are supplied from the conduits 32 and 33 through stationary concentric tubes 43 and 42, extending through the hollow shaft of the motor 31, to separate spray heads 45 and 44, respectively, from which they are sprayed towards the inner wall of the atomizer cup 30 to form films of liquid flowing down the inner wall and beginning to mix where the hardener liquid sprayed from the upper spray head 44 reaches the film of waterglass solution sprayed from the lower spray head 45. In a length of the tube 43 immediately ahead of the spray head 45 a static mixer 53 is built in, by means of which the waterglass solution and the silicone solution, which are both supplied through the tube 43, are subjected to a vigorous mixing operation so that they are sprayed from the spray head 45 in the form of a temporarily finely divided mixture, which again mixes with the hardener. At the lower edge of the cup 30 the mixture of the three liquids is atomized to form a mist 46 which impinges and penetrates into the curtain 28 of freely falling grains, whereby each grain is spray coated with a thin film consisting of a mixture of all three liquids. In this phase the liquid film is very little sticky so that the spray coated material will remain in granular form. The spray coated grains now roll down the inner face of the conical wall 8, and at the same time liquid remains, that may not have been caught by the particles, trickle down the same inner face, which is coated with Teflon in order efficiently to prvent particles and liquid from sticking to it. During this travel the liquid will be even more uniformly distributed over the surfaces of all grains by the gentle rubbing of the grains against each other and against any remains of liquid trickling down the wall. Surface tension effect will also assist in uniformly distributing the liquid over the surfaces of the grains. At a bottom opening 47 of the conical wall 8 the spray coated granular material is caught by a rotary valve 48 and sluiced into piping 49 extending from the pressure side of a blower and extending further to the spot for deposition on the surface to be coated, e.g. to the tangential inlet of a cyclone separator for pouring out the material on a roof, on which a screed coat is to be laid. A working team on the roof immediately spreads the poured out material, lightly compresses it, such as by beating or stroking it with a shovel or a float, and smoothes it with a straight-edge or screed board following guide bars that have beforehand been laid with the correct gradient towards the roof outlet. When an area of the screed coat has been finished, the guide bars may be removed and remounted for use in the finishing of the next successive area to be covered.

In the condition in which the material is poured out on the roof, fresh from the spray coating process, it is excellently workable for laying and shaping, and the presence of droplets of hydrophobizing agent on the film of adhesive on the surfaces of the grains forms no obstacle to the establishment of a firm adhesive bond between the grains, but suffices for making the screed coat permanently water repelling. Any compression before laying would detract from the workability and tend to make the material lumpy. By contrast, the pneumatic transportation of the freshly spray coated material rather has the effect of maintaining or improving the free granular nature of the material.

I claim:

1. A method of applying a coat of adhesively bonded expanded mineral grains to a surface of a structure, comprising the steps of causing a granular expanded mineral material to move in the form of a free flow (28) through an atomized spray (46) of an adhesive consisting of a solution of waterglass and a hardener therefor in such a manner as to form a film coating of said adhesive on the surface of each grain, and conveying the spray coated granular material, immediately after it has been thus produced, to the surface to be coated, depositing it on that surface and then spreading, compressing and smoothing it to form a coherent layer of a desired geometrical surface configuration, characterized in that a small amount of a hydrophobizing agent, which is non-emulsifiable in the adhesive, is introduced into the adhesive and is uniformly distributed therein by mechanical forces immediately before the atomizing operation.

2. A method as in claim 1, characterized in that the hydrophobizing agent is a silicone product emulsified in a liquid.

3. A method as in claim 2, characterizied in that the emulsified silicone product is a stable, water dilutable non-ionic polydimethyl siloxane.

4. A method as claimed in claim 3, characterized in that the ratio of emulsified silicone product to waterglass is 1–3% by weight.

5. A method as in claim 1, characterized in that the granular expanded mineral material is vermiculite.

6. A method as in claim 1, characterized in that the film coated granular material is pneumatically conveyed directly from the place of film coating to the place of deposition on the surface to be coated.

7. A method as claimed in claim 4, characterized in that the ratio of emulsified silicone product to waterglass is 1.5–2.5% by weight.

* * * * *